US007430035B2

(12) United States Patent
Iossiger et al.

(10) Patent No.: US 7,430,035 B2
(45) Date of Patent: Sep. 30, 2008

(54) AUTOMATIC DEVICE FOR TURNING THE PAGES OF A BOUND DOCUMENT

(75) Inventors: Ivo Iossiger, Morges (CH); Danick Bionda, Neuchatel (CH)

(73) Assignee: Assy S.A. (CH)

( * ) Notice: Subject to any disclaimer, the term of this patent is extended or adjusted under 35 U.S.C. 154(b) by 836 days.

(21) Appl. No.: 10/486,036

(22) PCT Filed: Aug. 13, 2002 (Under 37 CFR 1.47)

(86) PCT No.: PCT/CH02/00440

§ 371 (c)(1), (2), (4) Date: Dec. 17, 2004

(87) PCT Pub. No.: WO03/016072

PCT Pub. Date: Feb. 27, 2003

(65) Prior Publication Data

US 2006/0044631 A1 Mar. 2, 2006

(30) Foreign Application Priority Data

Aug. 13, 2001 (CH) ..... 1494/01

(51) Int. Cl.
*G03B 27/32* (2006.01)
*G10G 7/00* (2006.01)
*H04N 1/04* (2006.01)

(52) U.S. Cl. ..... 355/25; 84/487; 358/474

(58) Field of Classification Search ..... 355/25; 84/487; 358/474; 271/5, 11; 399/362
See application file for complete search history.

(56) References Cited

U.S. PATENT DOCUMENTS

| | | | | |
|---|---|---|---|---|
| 2,095,815 | A * | 10/1937 | Hopkins | 355/71 |
| 4,916,839 | A * | 4/1990 | Nakanishi | 40/475 |
| 4,942,482 | A | 7/1990 | Kakinuma et al. | |
| 5,471,277 | A * | 11/1995 | Fujioka et al. | 355/25 |

FOREIGN PATENT DOCUMENTS

| | | |
|---|---|---|
| EP | 0452911 | 10/1991 |
| FR | 2713149 | 6/1995 |
| GB | 2207423 | 2/1989 |
| JP | 3197094 | 8/1991 |

* cited by examiner

*Primary Examiner*—Alan A Mathews

(57) ABSTRACT

The invention concerns an automatic device for turning the pages of a bound document comprising a support (11) whereon is arranged the document, means (14) for separating by suction one page from the other pages to be turned and for turning the separated page to bring it on a pile of turned pages. The support (11) consists of two mobile trays (16) mutually linked by a rod (17), each tray consisting of a box (26) whereof the upper side is provided with small holes (27) cooperating with the suction intake orifices (28). The means (14) for separating the document pages consist of suction means (34), displaced by the combination of a vertical movement and a horizontal movement, consisting of the perforated recessed element (36) provided with a diaphragm (37). Said perforated element (36) is provided with holes (38) and the diaphragm (37) comprises two mobile parts for orienting the direction of the suction flow and modify its flow rate and its speed. Said suction means (34) also comprise mobile closure means (44) for longitudinally delimiting the suction surface. The means (14) for turning a page of the document comprise two mobile transparent plates (30) arranged in parallel planes. Control means (13) enable to measure the dimensions of the document and the number of pages turned.

16 Claims, 2 Drawing Sheets

AUTOMATIC DEVICE FOR TURNING THE PAGES OF A BOUND DOCUMENT

FIELD OF THE INVENTION

The present invention relates to a device for turning the pages of a bound document, particularly of a book, a magazine, an index file or a journal, in order to make pages accessible or to take a picture of these pages, that has a support on which the document is placed, some means arranged for separating one page from the other pages of the document by suction, and some means for holding the pages which are to be turned and for turning the separated page in order to bring it onto a stack of turned pages, said support being formed by two movable trays connected together by at least one rod, and with the document being placed on a roughly horizontal plane so as to be set on the pages forming the cover of the document, the visible pages being presented towards the top.

BACKGROUND OF THE INVENTION

At present devices already exist that enable turning the pages of a document automatically, for example, in order to photocopy or digitize it.

Such a device is described, for example, in the U.S. Pat. No. 4,943,502. This device has two transparent trays on which the document is set in such a way that the pages of the document are turned downward. Between the trays is a slot below which are two adjacent cylinders, one of which has suction holes. The document is held by a movable template so that it can be moved with respect to the trays. In order to turn a page, the document is pushed by means of the template in the direction of the slot. A page of this document is sucked by the cylinders provided with suction holes. This page turns between the two cylinders and penetrates into a housing situated below the cylinders. When the document continues to advance under the effect of the movement of the template, the page is withdrawn from the housing and placed on the side of the already turned pages.

This device has a certain number of disadvantages. Given that the sheets execute a trajectory around the suction cylinder, the device cannot be used for certain types of paper. In particular, it is not possible to turn board-bound pages. Moreover, a document must necessarily be open before beginning to turn the pages. Furthermore, if it contains a board-bound inset, the machine becomes immobilized. Because of the face downward position of the document and the curvature to which the pages are subjected, they can be damaged or destroyed, particularly when the pages which are presented are pressed by the weight of the document against the holding device. This device is therefore not suitable for old and/or valuable documents. Furthermore, given that the template must be suited to the dimensions of the document, the device is not very practical for dealing with documents with different formats. With the document turned downward, it is necessary to integrate in the support structure an apparatus which can do photocopies or digitization. This means that it is necessary to choose a given type of apparatus and that it is practically impossible later to change it without designing a completely new machine.

Another device, intended particularly for handicapped people, is also known through the French Patent FR 2 713 149. This device has two trays, mounted independently from one another using elastic means, on which the document is set. Each tray can apply the pages of a document against at least one finger. These fingers are retractable. The page turning component is a roller provided with a pressing device and has some means of lateral translation in order to go from one edge of the document to the other. The main disadvantage of this execution is connected with the fact that since the trays for holding the document are independent but connected by elastic means, it is very difficult to manage the force applied to the document between the trays and the retractable fingers.

The device to which the U.S. Pat. No. 4,691,909 relates has two movable trays which are inclined toward one another and on which the document is set. The page is held open by a device with rods that rest on the visible pages. A roller capable of turning is brought into forced contact against the document. It turns in one direction and can take several sheets. It brings these sheets against a squeezing member and then turns in the reverse direction in order to eliminate the extra pages. In a rocking movement, the roller and the squeezing member send the turned page onto the other side. This page falls back by its own weight, and it is regained by the rod device.

In these last two devices, the page turning component turns the pages and carries them along by friction on their surface, which can damage sensitive pages or even erase the contents at the point of friction. The page separation process requires the page carried along to be flexible so that it can become convex when it is pushed from its end towards its bound part. The effectiveness of the separation of the pages by friction and by relative movement is greatly dependent on the type of paper and on the surface condition of the paper. This type of page separation has difficulty guaranteeing that only a single page is turned at a time. Furthermore, the page holding fingers or rods have support points concentrated over a small area, which can mark or damage the document. These objects are also a problem with regard to the visibility of the pages.

U.S. Pat. No. 5,471,277 relates to a device for reading a document, provided with a page turner arranged for installation on a photocopier, a fax, or the like, which has a support table for the document and a page turner in the form of a belt made of dielectric material associated with an electrical field generator in order to attract the page electrostatically.

GB 2 207 423 relates to an apparatus for turning the pages of a document, which has a table on which the document is set open, some means for applying a frictional force to the upper page in order to raise it and allow air to insert itself between this page and the next one. The insertion of a horizontally movable transparent plate in the space thus created turns the raised page.

SUMMARY OF THE INVENTION

The present invention proposes to remedy the disadvantages of the known devices of prior art by realizing a device making it possible to turn the pages, from left to right or from right to left, of any type of document and of any form of bound work, regardless of the stiffness, the porosity, and the fragility of the pages, and which can be adapted easily to the chosen application.

Furthermore, the automatic working of this device automatically detects the case of grasping of a single page, of failure to grasp a page, of grasping multiple pages, of the end of the document, of flexible or stiff pages, and adapts itself to their specific handling without requiring human intervention.

These aims are attained by a device as defined in the preamble, and which is characterized by the fact that the means for separating the pages of the document entail a perforated hollow element which houses a diaphragm formed by two parts which are movable with respect to one another, each of these parts being provided with an open zone and a closed zone to enable orienting the direction of the suction flow and changing its flow rate and its speed by movement of one of the parts with respect to the other.

Advantageously, the perforated hollow element is movable with respect to the trays.

In a preferred embodiment of the invention, the perforated hollow element is provided with closing means arranged so as to longitudinally limit the suction surface.

In the preferred embodiment, the rod connecting the two trays pivots around a horizontal shaft, this horizontal shaft being vertically movable, which synchronizes the movement of the movable trays, and a compression component is arranged so as to counterbalance the weight of the elements supported by said horizontal shaft.

The trays advantageously have means for immobilizing their relative position, and each tray is connected with a horizontal return element arranged so as to allow the centering of the document.

Preferably, each tray is formed by a box having a planar upper surface provided with holes and at least one suction intake. This upper surface of the boxes can be provided with a mask suited to the size of the document whose pages are to be turned.

In one embodiment, the means for turning a page of the document comprise at least one transparent plate which is movable with respect to the trays.

In a variant, the means for turning a page of the document can comprise two transparent plates arranged in parallel planes, which are movable with respect to one another and with respect to the trays.

The device, moreover, has some means of inspection arranged so as to measure the dimensions of the document and the number of pages taken, as well as some means for measurement of the suction pressure in the perforated hollow element.

In all the embodiments, one or each transparent plate has a duct arranged, on an edge roughly parallel to the binding of the document, so as to expel air in the direction of the pages of said document, as well as at least one movable duct, perpendicular to said binding of the document, also arranged so as to expel air in the direction of the pages of said document.

According to the use of the device, the perforated hollow element can be equipped with a removable filtering element in order to protect the turned pages from contamination.

When the device is intended for taking a picture of the turned pages of the document, it has some means of recording these images.

BRIEF DESCRIPTION OF THE DRAWINGS

The present invention and its advantages will be better understood with reference to a preferred but non-limiting embodiment of the invention and to the appended drawing in which.

DETAILED DESCRIPTION

Figure 1:
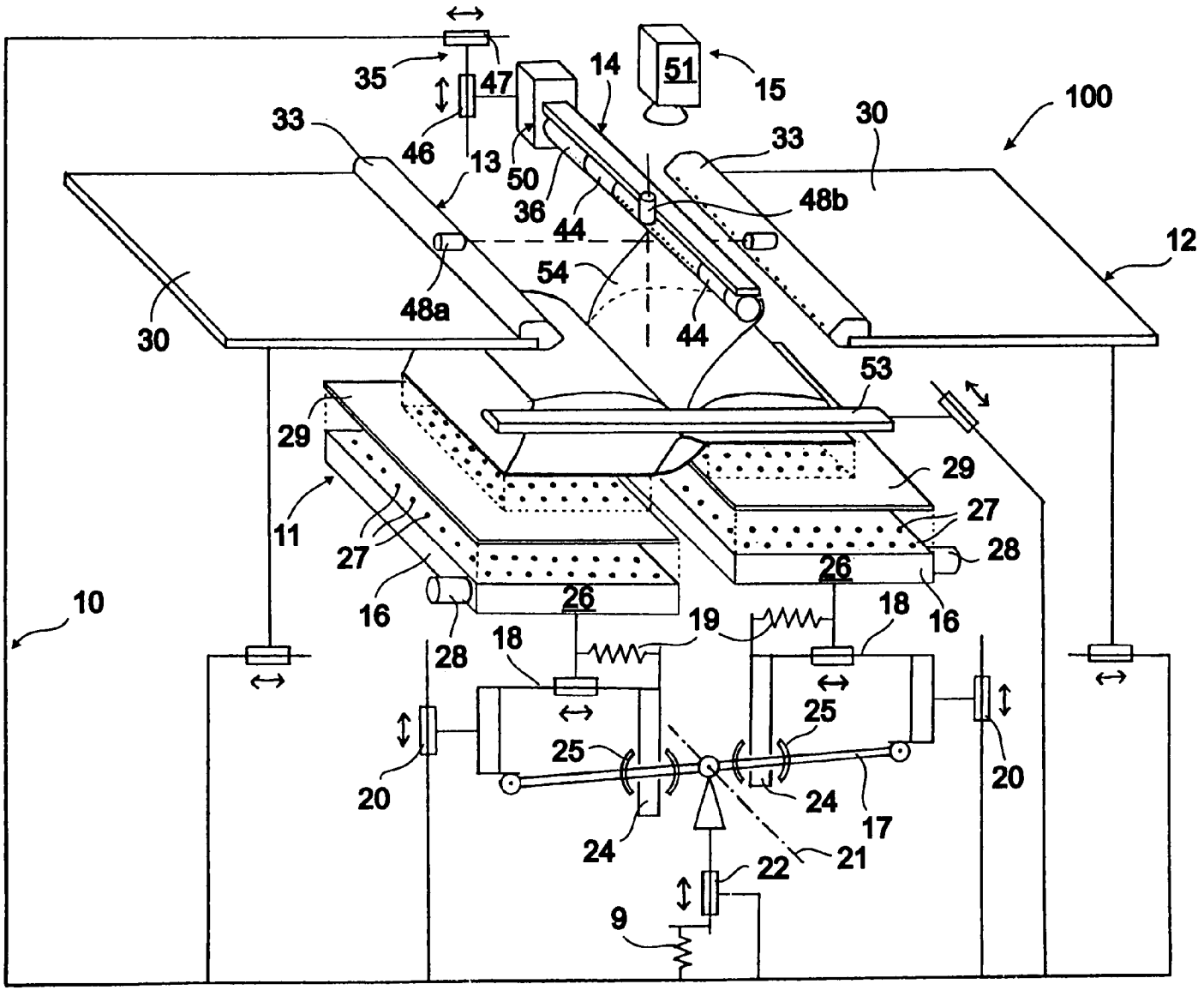
FIG. 1 is an overall diagrammatic view of the device according to the present invention.

With reference to FIG. 1, device 100 according to the present invention has support structure 10, in which are arranged support 11 for the document whose pages are to be turned, means 12 for holding the pages to be turned and for turning the separated page, means 13 for inspection of the pages which have been turned or are to be turned, means 14 for separating the pages to be turned and means 15 for recording images.

Support 11 for the document has two trays 16 connected together by means of rod 17. In a more detailed manner, each tray 16 is mounted on horizontal rail 18 which allows it to slide along a longitudinal axis with respect to the device. These horizontal rails are themselves connected with a carriage (not represented) which slides in vertical rail 20, which ensures a linear guidance of the trays. Rod 17 is articulated about its center. This center, which is materialized by shaft 21, can be moved in vertical guide 22 by means of a motor. In this way, the trays can be moved either in two opposite directions or in the same direction. In other words, when one of the trays is raised, the other can either be lowered around the center of rod 17 or also raised along vertical rail 20.

Each horizontal rail 18 is also connected with vertical bar 24 running in the vicinity of articulated rod 17. This rod is provided with means of immobilization 25 arranged in the vicinity of each of the vertical bars in such a way that when these means are actuated, they hold the bars and thus keep them from moving. Furthermore, compression component 9 connected to vertical rail 22 makes it possible to counterbalance the weight of the elements supported by horizontal shaft 21. In this way, trays 16 remain in their relative position regardless of the force applied to them.

Each tray is formed by box 26 whose roughly planar upper surface is provided with many small holes 27, and which has one or more suction intakes 28. This box can furthermore be provided with perforated mask 29 whose perforations coincide with holes 27 so that these holes are stopped by the cover of the document whose pages are to be turned, or by the mask. This makes suitable holding of the document possible and prevents leaks due to suction through the unstopped holes. Furthermore, centering of the document on the trays is ensured by horizontal return elements 19 connected with trays 16.

Means 12 for holding the pages to be turned and for turning the separated page entails at least one transparent plate or, in the example represented, two transparent plates 30, for example, made of glass, which are placed above the document. These plates can slide in a plane parallel to the pages of the document and in a direction perpendicular to the binding of this document. To this effect, they are connected with translational guiding elements which are known and are not represented.

The edge of the transparent plate which is in contact with the page of the document to be turned has duct 33 connected to a blower so that air is blown in the direction of the pages in order to push the sheet to be turned by a cushion of air. This makes it possible to turn the pages of the document very delicately and therefore to avoid any risk of damaging the documents, even particularly fragile ones, in particular by avoiding any friction with the page. Duct 33 can be placed on only one of the plates or on both of them, and the blower can be operated in one of the ducts or both as a function of the direction in which the pages are turned.

It is also possible to provide only one transparent plate 30 which covers the whole document during picture taking. In this case, it is desirable to provide a component for holding the pages of the document so that the document does not close by itself.

Means 14 for separating the pages of the document are composed of suction means 34 and means 35 for movement of these suction means. In the embodiment illustrated, they make it possible to turn the pages from left to right or from right to left. It is possible, however, to produce a machine with reduced dimensions if it only has to turn the pages in one direction.

Figure 2:
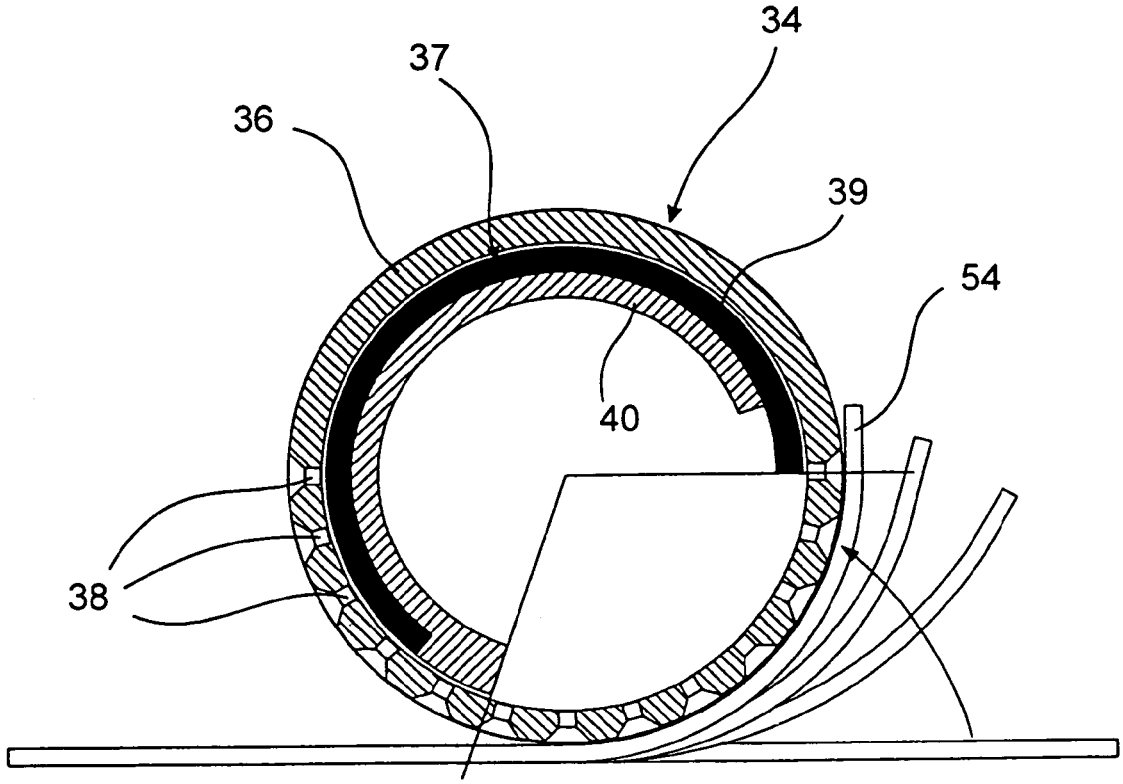
FIG. 2 is a section of a part of the device of FIG. 1, and FIGS. 3*a* and 3*b* are sections of the element of FIG. 2 in different positions.
Figure 3A:
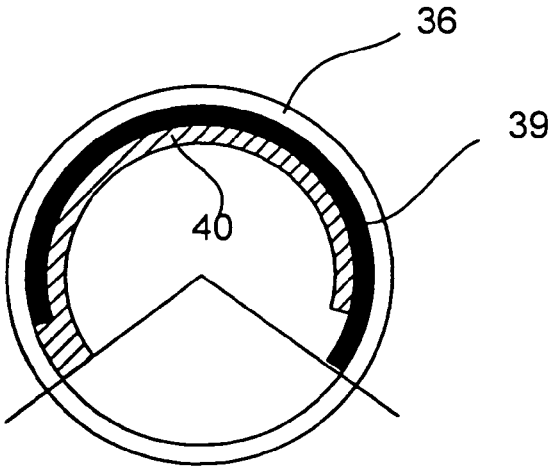
Figure 3B:
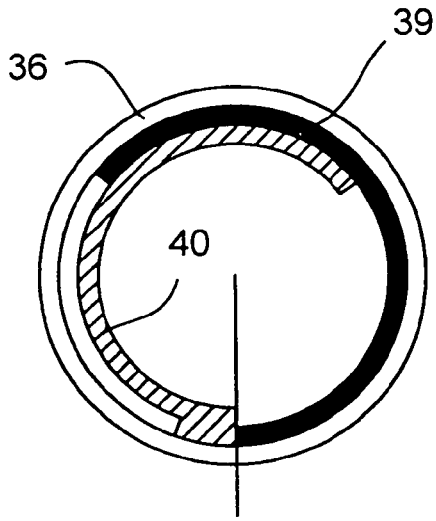

Suction means 34, illustrated in more detail in FIGS. 2, 3*a* and 3 [sic: 3*b*], are formed by a perforated hollow element which can take the form of tube 36 provided with diaphragm 37. Tube 36 has many holes 38 having a flared peripheral zone in the form of a suction cup. According to a preferred embodiment, the holes are arranged in a staggered manner on the lower surface of the tube so as to ensure optimal grasping of the sheets to be turned. Diaphragm 37 is formed by two parts 39 and 40 which are movable with respect to one another, and which can be produced in the form of tubes sliding into tube 36, each of these tubes being provided with a closed zone and an open zone such as a slot extending over an angular zone less than 180°, so that the rotation of one of the tubes with respect to the other makes it possible to close the diaphragm completely or to open it. Tubes 39 and 40 forming the diaphragm are supported by bearings.

These suction means 34 also have some closing means in order to longitudinally limit the suction surface. In the example represented, these closing means are formed by two movable sleeves 44 arranged at each end of tube 36 in such a way that holes 38 of said tube 36 can be stopped by a page of the document, by the diaphragm, or by one or the other of the sleeves. As in the case of mask 29 on the box, these sleeves ensure optimal suction. Furthermore, in order to protect the turned pages from contamination by particles or bacteria, perforated tube 36 can be equipped with a removable filtering element.

Means 35 for movement of these suction means include two rails, vertical rail 46 and horizontal rail 47, as well as driving motors. When a page is sucked up, tube 36 is displaced according to a relative movement with respect to the page that is obtained by the combination of a vertical movement and a horizontal movement.

Means of inspection 13 essentially makes it possible to make sure that a single page of the document is turned at a time. These means of inspection includes first telemeter 48*a* which takes a measurement of the number of pages grasped by the page separation means as well as second telemeter 48*b* making it possible to determine the exact position and size of the document.

The device also has means 50 for measurement of the pressure in suction means 34. In effect, when a page is sucked up, the pressure varies according to a determined curve. If a page has not been able to be grasped correctly, the pressure will remain constant, and the curve will not correspond to the conventional curve, and this will be detected.

The pressure measurement means 50 also makes it possible to distinguish a standard page of the document from a page which is different, such as, for example, a flexible page from a stiff page. In effect, a flexible sheet bends slightly around the tube of the suction means and stops a certain number of holes 38, which generates a determined pressure curve. When two standard sheets are taken at the same time, the pressure curve is practically identical to the curve for one sheet. By contrast, the number of pages measured by telemeter 48*a* differs. When a stiff sheet is grasped, it bends less than a standard sheet and stops fewer holes 38 of suction means 34. The pressure curve will be different from the conventional curve. Thus, it will be possible to not take into account the measurement made by telemeter 48*a*.

Image recording means 15 can be adapted to the chosen application. In effect, the pages can be photographed or scanned and digitized. According to a concrete embodiment, these recording means can include digital camera 51 which is stationary or movable and mounted so that it can move above the document on a set of rails connected with the support structure. This camera takes a picture of each double page, digitizes it and transmits it to a storage and/or processing system such as a computer (not represented).

Device 100 of the invention can also have mechanism 53 for separation of pages 54, in the form of a duct perpendicular to the binding of the document. Air is blown from this duct in a direction parallel to the binding, which has the effect of slightly separating the pages by introducing a small cushion of air between them. This very greatly reduces the friction between the pages and increases the reliability of the device by preventing several pages from being taken at the same time.

When one wishes to turn the pages of a document, one places it open or closed on support 11. In closed position, the document is placed on a single tray 16 of the support, for example, on the right when the document is turned from left to right [sic], in such a way that the binding of the document is in the vicinity of the edge of this tray. When the document is open, each of the cover pages is arranged on a tray in such a way that the binding is placed between these two trays. The two cover pages of the document are held in place by suction through holes 27 of box 26. This ensures suitable holding of the document while requiring no complex mechanical parts.

If one starts with a closed document, telemeter 48*b* is moved in order to determine the exact position and size of the document. The cover page is then opened. If one starts with the document open, the document is positioned on the two trays, telemeter 48*a* is moved longitudinally along the machine and measures at each point the distance between the telemeter and the document. This makes it possible to determine the position of the edges of a page as well as the position of the middle of the document.

The connection between trays 16 is such that regardless of the number of pages on each of the trays, the upper page of each part of the document is situated roughly in the same plane. In effect, [on] the side of the document with more pages and therefore the thicker side, the tray will be pressed downward. Thus, the two visible pages of the document will be roughly in the same plane.

The trays are locked in position by means of immobilization device 25 so that the pages of the document remain in the same plane when the document is moved away from plates 30.

In order to turn the pages from right to left, trays 16 are raised simultaneously until they press the document with a determined pressure against right transparent plate 30 of the device. The visible double page can then be dealt with, that is to say, photographed or scanned. In order to turn the page and thus allow the next double page to be dealt with, trays 16 are lowered simultaneously a distance such that the document cannot close up by itself, and the pages which have a tendency to turn are retained by one of transparent plates 30. The plates are then moved towards the left so that the left plate retains the pages of the document which have a tendency to close up, and the right plate has its free edge more to the right than the document. As can be seen in FIG. 1, a space is created between the two plates. This space is sufficiently wide to allow passage for suction means 34. These means are lowered and operated such that the edge of the right page is sucked up by tube 36, diaphragm 37 being adjusted so as to be suited to the stiffness of the pages.

The rotation of this diaphragm 37 in tube 36 of the suction means, as illustrated by FIGS. 3*a* (open position) and 3*b* (closed position), allows the suction force to be adjusted. In effect, if the slot of the diaphragm is such that it faces a small number of holes of the exterior tube, the suction force will be distributed over a very small number of holes, and will be greater. This is used when it is necessary to turn very stiff or heavy pages, such as board-bound cover pages or stiff inserts. On the other hand, when the open zone of the diaphragm is in contact with a large number of holes, the force per hole is relatively small. This mode of utilization is suitable for the interior pages of a document, which are generally flexible.

Adjustment of the suction force can be done manually, as a function of the grade of the paper of the document whose pages are to be turned. It can also be done automatically. In this case, the turning of the diaphragm is managed by motors which automatically adjust the angle of opening as a function of the paper.

Suction means 34 is then displaced according to a movement whose trajectory is obtained by the combination of a vertical movement and a horizontal movement. The two tubes 39 and 40 forming diaphragm 37 are also turned inside tube 36 such that the line bisecting the angle of opening of the diaphragm is always in contact with the same zone of the page to be turned. This bisecting line is oriented perpendicularly to the page during movement of the page to be turned. This becomes all the more important, the stiffer the page.

When suction means 34 has grasped a batch of one or more pages and this batch has been raised, telemeter 48*a* measures the number of pages grasped. If an insert whose thickness differs from that of conventional pages is grasped, this can be detected by means of measurement of the pressure in the suction means.

If one or more pages have been grasped simultaneously, suction means 34 is stopped, and the pages possibly taken are released. Another attempt is then begun.

The suction means are moved until they are arranged above the plane defined by right transparent plate 30. This plate is then moved towards the left.

When transparent plate 30 is sufficiently inserted under raised page 54, the suction means release the page by stopping the suction. This page-is carried along by the movement of the transparent plate. This movement is coordinated with the movement of the left plate which holds the document open. When the transparent plate entirely covers the document, the movements of the plates are stopped. Trays 16 are raised in such a way as to flatten the pages of the document against the transparent plates or to move the document a chosen distance closer to plates 30 when one does not wish to flatten the document. A picture of the two open pages is taken. The transparent plates are then moved towards the right so as to regain their initial position. A cycle is then begun again.

Blower duct 33 arranged on the edge of transparent plates 30 blows air before the plate comes in contact with the page to be turned. Thus, the page is pushed by a cushion of air and does not come in contact with the plate. It is possible in this way to deal with a particularly valuable and/or fragile document. This same duct can also blow air during the page separation phase.

Numerous parameters can be adjusted on device 100 according to the invention. In particular, the pressure applied on the document against transparent plates 30 can be suited to the document. Thus, for fragile documents or those with bindings of mediocre quality, the document can be simply placed open on support 11 with no pressure applied. The picture of the document taken by recording means 15 can be worked on by computer means in order to correct the deformations due to lack of flatness of the document.

This device has numerous advantages with respect to the similar devices of the prior art.

First of all, it makes it possible to use documents with practically any format without it being necessary to perform tedious manual adjustments. According to a concrete embodiment, the document can have any size including the format A6 and the format A1. It also automatically adapts itself to a wide variety of paper grades or thicknesses. Furthermore, the documents can be naturally placed closed on support 11 without it being necessary to position them in a particular manner.

Moreover, it can be used to turn the pages of particularly fragile documents, allowing old or rare documents to be digitized or copied, for example.

The speed of movement of the different components can be increased or slowed down as a function of the fragility of the pages of the document. All the movements of the components can be motorized.

Since trays 16 can be moved vertically, it is possible to press the document against the transparent plates in such a way that the two pages are flat. For documents with a fragile binding, it is also possible to leave a certain distance between the document and the transparent plates. In this case, the distance must merely be close enough to prevent the pages from turning by themselves.

The means of inspection make it possible to ensure that all the pages will be turned one after the other, one page at a time.

The invention claimed is:

1. An automatic device for turning the pages of a bound document, comprising: support (11) on which the document is placed, first means (14) arranged for separating one page from the other pages of the document by suction, and second means (12) for holding the pages which are to be turned and for turning the separated page in order to bring it onto a stack of turned pages, said support (11) being formed by two movable trays (16) connected together by at least one rod (17), and with the document being placed in a roughly horizontal plane so as to be set on the pages forming the cover of the document, the visible pages being presented towards the top, wherein the first means for separating the pages of the document entail perforated hollow element (36) which houses diaphragm (37) formed by two parts (39, 40) which are movable with respect to one another, each of these parts being provided with an open zone and a closed zone so as to be able to orient the direction of the suction flow and to change its flow rate and its speed by movement of one of the parts with respect to the other.

2. A device according to claim 1, wherein said perforated hollow element (36) is movable with respect to trays (16).

3. A device according to claim 1, wherein said perforated hollow element (36) is provided with closing means (44) arranged so as to longitudinally limit the suction surface.

4. A device according to claim 1, wherein said rod (17) pivots around a horizontal shaft (21), this horizontal shaft being vertically movable, and by the fact that compression component (9) is arranged so as to counterbalance the weight of the elements supported by said horizontal shaft (21).

5. A device according to claim 1, wherein said trays (16) have means (25) for immobilization of their relative position.

6. A device according to claim 5, wherein said each tray (16) is connected with horizontal return element (19) arranged so as to allow centering of the document.

7. A device according to claim 1, wherein each tray (16) is formed by box (26) having a planar upper surface provided with holes (27) and at least one suction intake (28).

8. A device according to claim 7, wherein the upper surface of boxes (26) is provided with a mask adapted to the size of the document whose pages are to be turned.

9. A device according to claim 1, wherein the second means for turning a page of the document comprise at least one transparent plate (30) which is movable with respect to trays (16).

10. A device according to claim 9, wherein the second means for turning a page of the document comprise two transparent plates arranged in parallel planes, which are movable with respect to one another and with respect to trays (16).

11. A device according to claim 1 further comprising a means of control (13) arranged so as to measure the dimensions of the document and the number of pages taken.

12. A device according to claim 1 further comprising a means (50) for measurement of the suction pressure in perforated hollow element (36).

13. A device according to claims 9 wherein at least one transparent plate (30) has, on an edge roughly parallel to the binding of the document, duct (33) arranged so as to expel air in the direction of the pages of said document.

14. A device according to claim 13 wherein the second means for turning page (54) of the document comprise one movable duct (53) perpendicular to the binding of the document and arranged so as to expel air in the direction of the pages of said document.

15. A device according to claim 1 wherein said perforated hollow element (36) is equipped with a removable filtering element in order to protect the turned pages from contamination.

16. A device according to claim 1 further comprising means (15) for recording images of the pages of the document which is being dealt with.

* * * * *